US008199084B2

(12) United States Patent
Ku et al.

(10) Patent No.: US 8,199,084 B2
(45) Date of Patent: Jun. 12, 2012

(54) DRIVING CIRCUIT OF FLAT PANEL DISPLAY DEVICE

(75) Inventors: Tzong-Yau Ku, Tainan County (TW); Bou-Herng Hwei, Tainan County (TW); Yung-Yu Tsai, Tainan County (TW)

(73) Assignee: Chimei Innolux Corporation, Chu-Nan (TW)

( * ) Notice: Subject to any disclaimer, the term of this patent is extended or adjusted under 35 U.S.C. 154(b) by 1357 days.

(21) Appl. No.: 11/178,345

(22) Filed: Jul. 12, 2005

(65) Prior Publication Data

US 2006/0033691 A1 Feb. 16, 2006

(30) Foreign Application Priority Data

Jul. 23, 2004 (TW) ..... 93122119 A

(51) Int. Cl.
*G09G 3/36* (2006.01)

(52) U.S. Cl. ..... 345/87; 349/40

(58) Field of Classification Search ..... 345/87
See application file for complete search history.

(56) References Cited

U.S. PATENT DOCUMENTS 6,750,926 B2 * 6/2004 Ohgiichi et al. ..... 349/40
7,268,776 B2 * 9/2007 Kim et al. ..... 345/206
2002/0158859 A1 * 10/2002 Nakano et al. ..... 345/204

* cited by examiner

*Primary Examiner* — Amare Mengistu
*Assistant Examiner* — Vinh Lam
(74) *Attorney, Agent, or Firm* — Liu & Liu

(57) ABSTRACT

A driving circuit of a flat panel display device includes a horizontal bus, a plurality of horizontal driver ICs, a vertical bus, and a plurality of vertical driver ICs. The horizontal driver IC is operative to decode N-types of vertical driving signals output from the horizontal bus, so as to transmit the N-type vertical driving signals to the corresponding vertical driver IC via a vertical signal line of the vertical bus.

16 Claims, 4 Drawing Sheets

DRIVING CIRCUIT OF FLAT PANEL DISPLAY DEVICE

BACKGROUND OF THE INVENTION

1. Field of Invention

The present invention relates in general to a structure of a driving circuit of a flat panel display device, and more particular, to a driving circuit of a flat panel display device operative to deliver more driving signals with less number of signal lines.

2. Related Art

The flat panel display device is a very popular display device, among which the liquid crystal display device has been widely applied to desktop personal computer, laptop computer, personal data assistant, and other portable information technique devices because of the features of light, thin, low power consumption, and non-radio pollution. The conventional monitors and television using cathode ray tubes have been gradually replaced by the flat panel display devices.

In general, the driving circuit of the liquid crystal display device uses a tape carrier package (TCP) packaged with a plurality of driver ICs to electrically connect the printed circuit board of an image processing device and a lower glass substrate of a liquid crystal display panel, so as to transmit control signal from the printed circuit board to corresponding driver ICs, followed by inputting the processed signals to each pixel of the lower glass substrate. To save the cost and to improve the exterior dimension of the product, the wiring on array (WOA) structure is generally adapted in the liquid crystal display device.

FIG. 1 shows a conventional WOA liquid crystal display device 10 including a liquid crystal display panel 12, a plurality of source TCPs 14 electrically connected to a horizontal edge of the liquid crystal display panel 12 and a source PCB 16, a plurality of gate TCPs 18 electrically connected to a vertical edge of the liquid crystal display panel 12, a plurality of source driver ICs 20 each formed on a corresponding source TCP 14, and a plurality of gate driver ICs 22 each formed on a corresponding gate TCP 18. In addition, the liquid crystal display panel 12 includes a lower substrate 24 of thin-film transistor for allocating each signal lines, an upper substrate 26 for allocating color filters and a liquid crystal layer (not shown) sandwiched between the lower and upper substrates 24 and 26. The liquid crystal display panel includes a picture display area 28 which comprises a plurality of scan lines 30 and data lines 32 perpendicularly intersecting each other to electrically connect the corresponding gate driver IC 22 and the corresponding source driver IC 20, respectively.

As shown in FIG. 1, the source TCPs 14 include a plurality of source input pads 34 and a plurality of source output pads 36 for electrically connecting the source PCB 16 to the data lines. Further, the source PCB 16 closest to the gate TCPs 18 includes a set of gate driving signal transmission line 37 for electrically connecting the WOA gate driver bus 38 on the lower substrate 24 in WOA manner. Each of the gate TCPs 18 includes a set of gate driving signal transmission line 40 and a plurality of gate output pads 42 electrically connected to the corresponding gate driver ICs 22.

As shown in FIG. 1, the signal transmitted from the source PCB 16 includes a gate driving signal and a source driving signal. The source driving signal is transmitted to the source driver IC 20 from the source PCB 16 via the source input pad 34, through which the source diving signal is further delivered to various data lines 32. On the other hand, the gate driving signal is transmitted from the source PCB 16 to the gate driving signal transmission line 37 of the source TCP 14. Being transmitted to the gate driving signal transmission line 40 of the gate TCP 18 by the WOA gate driving signal bus 38, through such step, the gate driving signal is transmitted to the scan line 30 of each gate driver IC 22. Therefore, the conventional liquid crystal display device 10 requires a gate driving signal transmission line 37 installed in the source TCP 14 to transmit the gate driving signal. Thus design, the surface area of the horizontal side of the liquid crystal display panel 12 has to be increased for installing the source TCP 14 including gate driving signal transmission line 37 and the WOA gate driving signal bus 38.

Further, to further reduce cost, the industry has developed a liquid crystal display device based on chip on glass (COG) technique. That is, the source driver IC 20 and the gate driver IC 22 installed on the lower substrate surface of the liquid crystal display panel are realized by forming a source driving transmission line in a flexible printed circuit (FPC) to electrically connect the source driver IC, so as to transmit the source driving signal. Meanwhile, the gate driving signal transmission is formed in the FPC, and a WOA gate driving signal bus formed on the horizontal and vertical sides of the liquid crystal display panel provides the electrical connection from the gate driving signal transmission to each gate driver IC. This technique, although reduces partial cost by using COG to form the source and gate driver IC on the lower substrate surface, cannot resolve the problem of increased surface area of the horizontal side of the liquid crystal display panel required for forming the signal transmission devices related to the gate driving signal.

Therefore, it is a substantial need for the industry to effectively reduce the number of signal lines for driving signal transmission, to reduce the wiring space of the substrate surface of each liquid crystal display device, and to reduce the panel area and cost.

SUMMARY OF THE INVENTION

The present invention is to provide a driving circuit of a flat panel display device including only one to two signal lines formed on a substrate surface of a flat panel display device to perform transmission of multiple driving signals. Therefore, the space of the flat panel display device can be effectively saved to resolve the problem occurring to the conventional flat panel display device.

Accordingly, the driving circuit of a flat panel display device includes a horizontal bus allocated on a surface of an array substrate, a plurality of horizontal driver ICs allocated above the horizontal bus, a vertical bus allocated on the surface of the array substrate and a plurality of vertical driver ICs allocated above the vertical bus. The horizontal bus includes a first horizontal signal line and a clock signal line. The first horizontal signal line is operative to perform decoding for transmitting N types of vertical signals and N is larger than 2. The horizontal driver ICs are electrically connected to the horizontal bus in series. The vertical bus includes at least N vertical signal lines for transmitting the N vertical driving signals transmitted from the first horizontal signal line. The vertical driver ICs are electrically connected to the vertical bus in series. The horizontal driver ICs includes a first driver IC electrically connected to the vertical bus to decode the N vertical driving signals transmitted from the fist horizontal signal line, so as to transmit the decoded N vertical driving signals to each vertical driver IC through the corresponding vertical signal line.

In the driving circuit of a flat panel display device as provided, a horizontal signal line for transmitting a plurality of vertical driving signals is formed in a horizontal bus, such that the number of the WOA signal lines on the horizontal side of the flat panel display panel is greatly reduced. The wiring space and the cost are thus saved, and the demand of minimizing the size of the flat panel display device can be met with.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
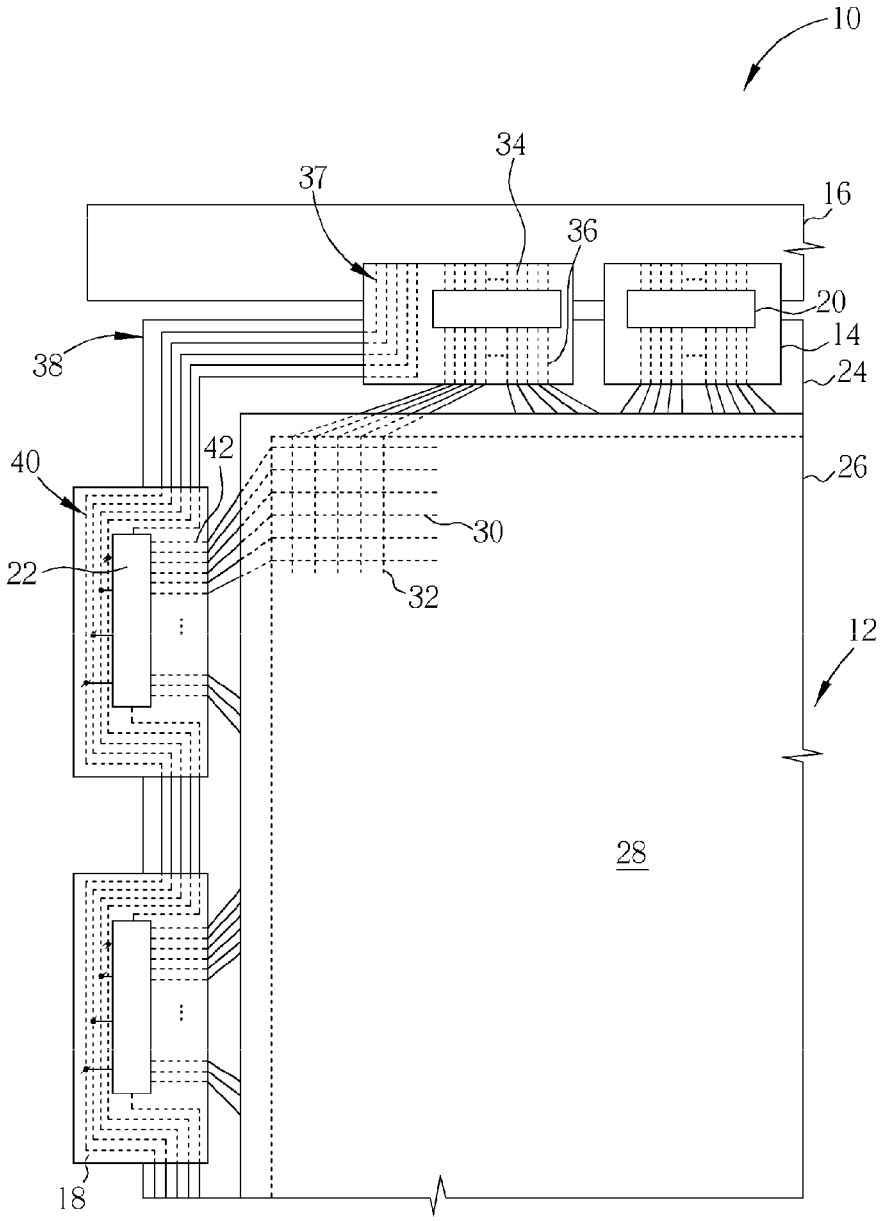
FIG. 1 (Prior Art)
FIG. 1 is a schematic drawing of a conventional WOA liquid crystal display device.
Figure 2:
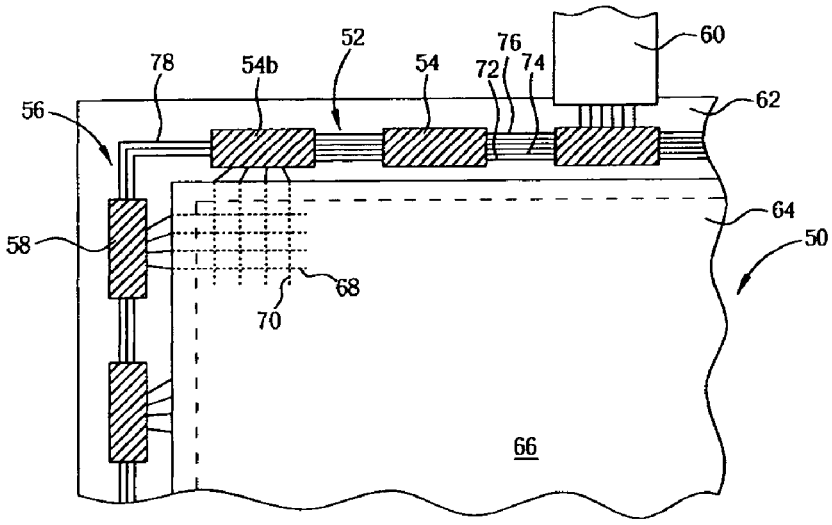
FIG. 2 is a schematic drawing of a driving circuit for a flat panel display device.

As the liquid crystal display devices have become the leading stream of the current flat panel display device, the following embodiments all use the liquid crystal display devices as examples for describing the driving circuit. As shown in FIG. 2, the flat panel display device includes a liquid crystal display panel 50, a horizontal bus 52, a plurality of horizontal ICs 54, a vertical bus 56, a plurality of vertical driver ICs 58, and a flexible printed circuit 60. The horizontal bus 52, the horizontal driver ICs 54, the vertical bus 56 and the vertical driver ICs 58 represent the source bus, the source driver ICs, the gate bus and the gate driver ICs on a liquid crystal display panel 50, respectively. In addition, each horizontal driver IC 54 and each vertical driver IC 58 are formed over the horizontal bus 52 and the vertical bus 56 and electrically connected to the horizontal bus 52 and the vertical bus 56 in series, respectively. The liquid crystal display panel 50 includes a lower substrate 62 serving as an array substrate to allocate each signal line and the thin-film transistors and an upper substrate for installing the color filters. The liquid crystal display panel 50 includes a picture display area 66 operative to display images by pixels intersected by a plurality of scan lines 68 and a plurality of data lines 70. The horizontal bus 52 and the vertical bus 56 are formed on the surface of the lower substrate in the WOA format. That is, the lower substrate 62 is a WOA substrate.

The horizontal bus 52 includes a plurality of horizontal signal lines 76, such as a clock transmission line 76 for transmitting clock signal, a first horizontal signal line 72 and a second horizontal signal line 74 for transmitting a plurality of vertical driving signals, that is, the gate driving signals of the liquid crystal display panel 50, including various low-frequency gate driving signals such as the vertical clock (CKV) signal, vertical synchronizing (STV) signal, and output enable (OE) signal. The first and second horizontal signal lines 72 and 74 can also be used to transmit a plurality of horizontal signals, including various low-frequency source driving signals such as horizontal clock (CKH) signal, polar control (POL) signal, and strobe (STB) signal.

Figure 3:
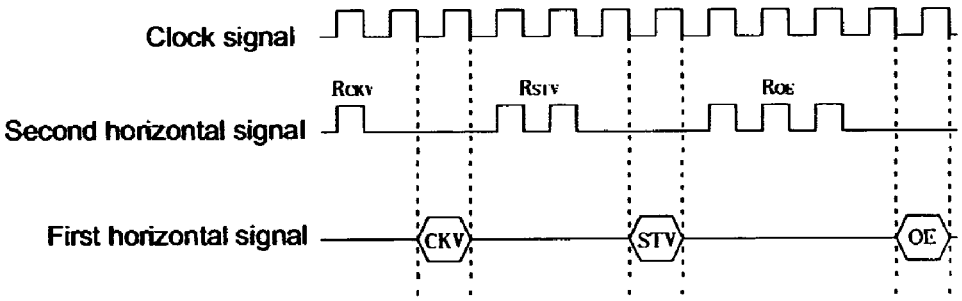
FIG. 3 is a schematic drawing showing the signal transmission in a first embodiment.

Referring to FIG. 3, the transmission of the first and second horizontal signal lines is illustrated. In the embodiment as shown, the signals carried by the first horizontal line 72 include the low-frequency vertical driving signal such as CKV signal, STV signal and OE signal. The second horizontal signal line 74 is operative to transmit signals include 3 type of identification codes R to indicate the vertical driving signal transmitted by the first horizontal line 72. Therefore, when the second horizontal line 74 generates an identification code R, a corresponding vertical driving signal will be generated by the second horizontal line 74 at the next period. As shown in FIG. 3, the second horizontal line 74 uses a plurality of continuous pulses to represent different identification codes R. When the second horizontal line 74 transmits an identification code $R_{CKV}$ while only one pulse is presented, it indicates that the next period after the pulse stops, the first horizontal signal line 72 will transmit the corresponding CKV signal. When the two pulses continuously presented while the second horizontal signal line 74 transmits the identification code $R_{STV}$, the first horizontal line 72 will transmit a corresponding STV signal at the next period after the continuous pulses stop. Similarly, when the second horizontal signal line 74 presents three pulses and the identification code $R_{OE}$, the first horizontal signal line will transmit an OE signal after the identification code $R_{OE}$ stops. Simply speaking, if the first horizontal line 72 has N types of vertical driving signals to transmit, the second horizontal signal line 74 is required to transmit at least N types of identification codes. When the second horizontal signal line 74 uses M pulses to represent the $M^{th}$ identification code, the $M^{th}$ vertical driving signal will be transmitted in the next period after the M pulses stop by the first horizontal signal line 72.

Further referring to FIG. 2, among the horizontal driver ICs 54 mounted on the liquid crystal display panel 50, one horizontal driver IC 54*b* closest to the vertical bus 56 is electrically connected thereto, so as to be operative to decode various driving signals transmitted from the first horizontal signal line 72. In the current embodiment, the first horizontal driver IC 54*b* identifies and decodes the vertical driving signals according to the identification codes R provided by the second horizontal line 74. The decoded vertical driving signal is then transmitted from vertical bus 56 electrically connected to the first horizontal driver IC to each vertical driver IC 58 through the corresponding vertical signal line 78.

Figure 4:
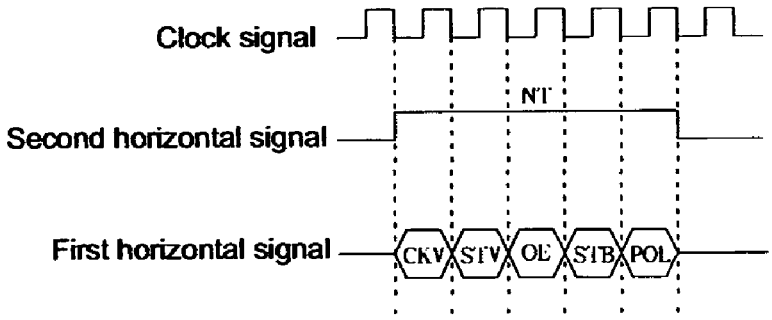
FIG. 4 is a schematic drawing showing the signal transmission in a second embodiment.

In FIG. 4, the first and second horizontal signal lines 72 and 74 are operative to transmit vertical driving signals CKV, STV, OE and horizontal signals STB and POL. The clock signal line 76 is operative to continuously transmit a plurality of clock signals, the second horizontal signal line 74 is used to transmit a program inform code NT, and the first horizontal signal line 72 is used to sequentially transmit various driving signals carried thereby synchronously when the second horizontal signal line 74 provides the program inform code NT. In the second embodiment as shown in FIG. 4, program inform code NT is at a high state. When the second horizontal signal line 74 presents high state for five clocks, the first horizontal signal line 72 will start transmitting CKV, STV, OE, STB and POL signals when the second horizontal signal line 74 presents the first clock period at the high state. Each of the above signal is transmitted within one clock period.

In this embodiment, the first horizontal driver IC 54*b* reads and decodes the driving signal transmitted from the first horizontal signal line 72 according to the clock signal transmitted form the clock signal line 76 and the program inform code NT transmitted by the second horizontal signal line 74. The decoded vertical driving signal is transmitted to each vertical driver IC 58 through the vertical signal line 78 electrically connected to the first horizontal driver IC 54*b*.

Figure 5:
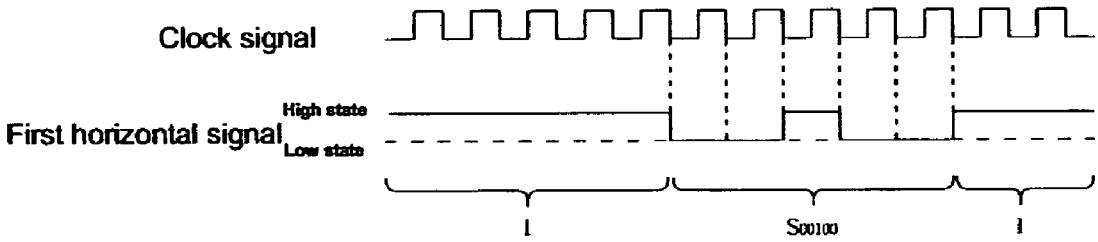
FIG. 5 is a schematic drawing showing the signal transmission in a third embodiment.

Referring to FIG. 5, the first horizontal driver IC 54*b* decodes each driving signal according to only the clock signal transmitted from the clock signal line 76. The signal transmitted by the first horizontal signal line 72 includes an interval code I and a plurality of signal control codes S. An interval code I is transmitted before transmitting each signal control code S. Each signal control code S represents a state or content of a driving signal. As shown in FIG. 5, the interval code I includes high states of five continuous pulse, and five program control codes $S_{00100}$ of five pulses is transmitted between two interval codes I. Each program control code S, for example, $S_{10000}$, $S_{01000}$ or $S_{00010}$, represents one state of driving signal. Therefore, the first horizontal driver IC 54*b* can read the content of and decode the program code S after each interval code I according to the setup content or a lookup table thereof, so as to transmit the decoded driving signal to each vertical signal line 78 of the vertical bus 56. In this embodiment, the horizontal bus 52 does not require the second horizontal signal line 74 for assisting transmission of multiple driving signals. The first horizontal driver IC 54*b* only needs to decode the signal transmitted from the first horizontal signal line 72 according to the clock signal.

Figure 6:
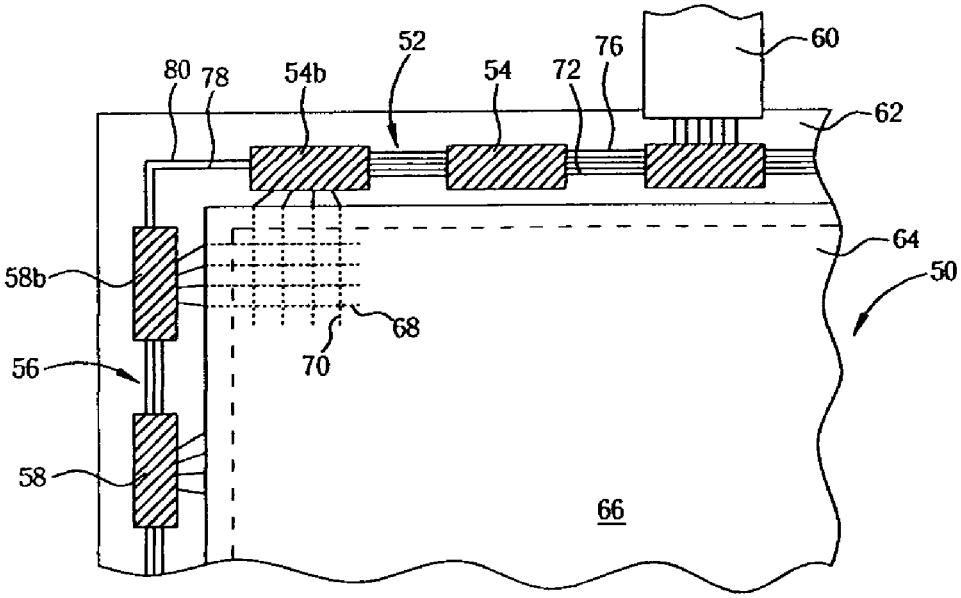
FIG. 6 is a schematic drawing showing the signal transmission in a fourth embodiment.

Referring to FIG. 6, same numeral references are used for the same elements or components as shown in FIG. 2. The liquid crystal display panel 50 includes a horizontal bus 52, a plurality of horizontal driver ICs 54, a vertical bus 56, a plurality of vertical driver ICs 58, and a flexible printed circuit 60. The horizontal bus 52 and the vertical bus 56 each includes a plurality of horizontal signal lines and vertical lines for transmitting horizontal driving signals and vertical driving signals. Each horizontal driver IC 54 and each vertical driver IC 58 are allocated over the horizontal and vertical buses 52 and 56, respectively, so as to electrically connect in series thereto.

However, between the first horizontal driver IC 54*b* closest to the vertical bus 56 and the first vertical driver IC 58*b* closest to the horizontal bus 52, there exists only one clock signal line 80 and one vertical signal line 78. The vertical signal line 78 uses the decode method as described in the previous embodiment to transmit a plurality of vertical driving signals. In addition, the first driver IC 58*b* is operative to read various vertical driving signals transmitted from the vertical signal line 78, so as to transmit various driving signals to each vertical driver IC 58 via various vertical signal lines of the vertical bus 56.

The first vertical driver IC 58*b* is operative to read the vertical driving signals, such that only two signal lines are required between the first horizontal driver IC 54*b* and the first vertical driver IC 58*b*, that is, the clock signal 80 and the vertical signal line 78 to transmit the required vertical driving signals required by the vertical driver IC 58. The design as provided can thus effectively save the wiring numbers and space between the first horizontal driver IC 54*b* and the first vertical driver IC 58*b*.

Figure 7:
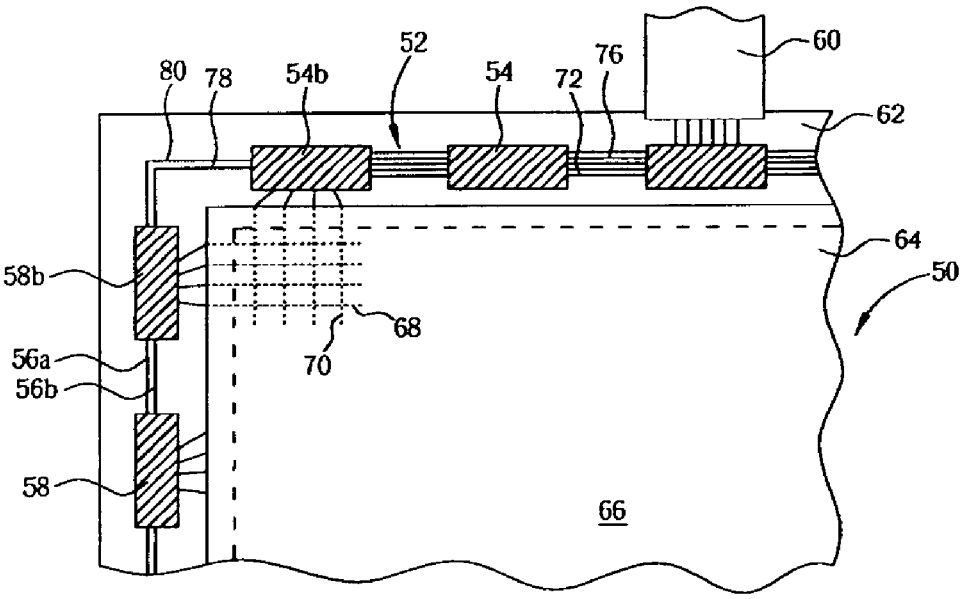
FIG. 7 is a schematic drawing showing the signal transmission in a first embodiment.

In FIG. 7, same numeral references are used to denote the same devices or components that have been shown in FIG. 6. The liquid crystal display panel 50 includes a horizontal bus 52, a plurality of horizontal driver ICs 54, two vertical signal lines 56*a* and 56*b*, a plurality of vertical driver ICs 58 and a flexible printed circuit 60 on a surface thereof. In this embodiment, each vertical driver IC 58 is operative to decode. Therefore, only two signal lines, namely, the clock signal line 56*a* and the vertical signal line 56*b*, are formed between the vertical driver ICs 58 to serially connect the vertical driver ICs 58, so as transmit the signals similar to those transmitted by the clock signal line 80 and the vertical signal line 78. With such design, the clock signal line 56*a* and the vertical signal line 56*b* use the signal transmission method as discussed in the third embodiment to transmit the driving signal to each vertical driver IC 58, which then decode the vertical driving signal according to the clock signal transmitted by the clock signal line 56*a*. Thereby, the overall wiring numbers between the vertical driver ICs 58 can be minimized.

Compared to the conventional technique, the driving circuit of the flat panel display device as provided requires only one or two signal lines formed on the display panel by using the high frequency to carry low-frequency. By incorporating the clock signal, a plurality of signals can be transmitted with reduced wiring number. Therefore, the fabrication cost is lowered, the wiring and layout are improved, and the market trends of thinner panel or larger display area can be provided. It will be appreciated that although the above embodiments use liquid crystal display devices as examples for the convenience of description, the driving circuit as provided can also be applied to other types of flat panel display devices such as the plasma display device or organic light emitting display device.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A driving circuit of a flat panel display device having an array substrate, comprising:

a first horizontal signal line formed on a surface of the array substrate to transmit a plurality of horizontal driving signals and in addition to transmit N types of vertical driving signals by decoding technique, wherein N is larger than 2;

a first clock signal line parallel with the first horizontal signal line and formed on the surface of the array substrate;

a plurality of horizontal driver ICs, formed over the array substrate and electrically connected to the first clock signal line in series;

at least one vertical signal line formed on the surface of the array substrate to transmit the N vertical driving signals transmitted from the first horizontal signal line; and a plurality of vertical driver ICs formed over the array substrate and electrically connected to the vertical signal line in series; wherein between a first horizontal driver IC closest to the vertical signal line and a first vertical driver IC closest to the first horizontal signal line, there exist only one first clock signal line transmitting clock signal, and only one vertical signal line transmitting N decoded vertical driving signals, and the first vertical driver IC is operative to decode and read the N vertical driving signals transmitted from the first horizontal signal line, and the vertical driving signals are transmitted from the first horizontal signal lines to the vertical signal lines, the vertical driver IC transmits the N vertical driving signals transmitted from the first horizontal signal line, and the vertical driver ICs are connected to the first clock signal line.

2. The driving circuit of claim 1, comprising at least N vertical driving signal lines formed on the surface of the substrate.

3. The driving circuit of claim 2, wherein the N vertical driving signals being decoded by the first vertical driver IC are transmitted to each vertical driver IC via a corresponding vertical signal line.

4. The driving circuit of claim 1, wherein the first vertical IC is operative to read and decode the N vertical driving signals according to the clock signal transmitted from the first clock signal line.

5. The driving circuit of claim 4, wherein each of the N vertical signals transmitted by the first horizontal signal line include an interval and a plurality of signal control codes, and each of the signal control codes represent a state of the vertical driving signals.

6. The driving circuit of claim 5, wherein the first horizontal signal line is operative to transmit one interval code before transmitting each of the signal control codes.

7. The driving circuit of claim 1, further comprising a second horizontal signal line electrically connected to the first vertical driver IC, and the first vertical driver IC is operative to read and decode the N vertical driving signals transmitted from the first horizontal signal line according to the clock signal transmitted from the first clock signal line and a signal transmitted from the second horizontal signal line.

8. The driving circuit of claim 7, wherein the signal transmitted from the second horizontal signal line includes a program inform code transmitted synchronously when the first horizontal signal line transmits the N vertical driving signals.

9. The driving circuit of claim 7, wherein the signal of the second horizontal signal line includes N types of identification codes each representing one of the N vertical driving signals provided for the first horizontal driver ICs to identify and decode, and when the second horizontal signal line transmits one of the identification codes, the first horizontal signal line transmits the corresponding vertical driving signal at the next period following the identification code.

10. The driving circuit of claim 1, wherein the flat panel display device includes a liquid crystal display device, and the array substrate includes a WOA substrate.

11. The driving circuit of claim 10, wherein the horizontal bus and the vertical bus include a source bus and a gate bus, respectively, and the horizontal and vertical driver ICs include a plurality of source and gate driver ICs, respectively.

12. The driving circuit of claim 1, wherein the first horizontal signal is further operative to transmit M types of horizontal driving signals, and the first horizontal driver ICs are operative to decode both the decode the N vertical driving signals and the M horizontal driving signals.

13. The driving circuit of claim 1, further comprising a second clock signal line parallel to the vertical signal lines and allocated on the surface of the array substrate, wherein the vertical driver ICs are electrically connected to the second clock signal line in series.

14. The driving circuit of claim 13, wherein the vertical signal lines are operative to transmit the N vertical driving signals transmitted from the first horizontal signal line based on decoding technique.

15. The driving circuit of claim 14, wherein each of the vertical driver ICs are operative to decode and read the N vertical driving signals transmitted from the vertical signal lines.

16. The driving circuit of claim 15, wherein each of the vertical driver ICs is operative to read and decode the N vertical driving signals transmitted from the first horizontal signal line according to the clock signal of the second clock signal line.

* * * * *